US007036887B2

(12) United States Patent
Kneier

(10) Patent No.: US 7,036,887 B2
(45) Date of Patent: May 2, 2006

(54) CHAIR WITH ATTACHED FOOTREST FOR PUTTING ON AND REMOVING FOOTWEAR

(76) Inventor: Andrew William Kneier, 265 Giles St., Nevada City, CA (US) 95959

( * ) Notice: Subject to any disclaimer, the term of this patent is extended or adjusted under 35 U.S.C. 154(b) by 0 days.

(21) Appl. No.: 10/814,739

(22) Filed: Apr. 1, 2004

(65) Prior Publication Data

US 2005/0218709 A1 Oct. 6, 2005

(51) Int. Cl.
*A47C 7/62* (2006.01)
*A47C 1/12* (2006.01)

(52) U.S. Cl. ..... 297/446.1; 297/188.1

(58) Field of Classification Search ..... 297/446.1, 297/423.1, 188.1, 153, 188.09, 188.08, 188.11; 182/91

See application file for complete search history.

(56) References Cited

U.S. PATENT DOCUMENTS

| | | | | | |
|---|---|---|---|---|---|
| 155,016 | A | | 9/1874 | Eberhard | |
| 155,524 | A | | 9/1874 | Lambert | |
| 575,941 | A | * | 1/1897 | Baker | 297/467 |
| 798,171 | A | | 6/1905 | Bartlett | |
| 794,461 | A | | 7/1905 | Mackey | |
| 910,818 | A | * | 1/1909 | Hook | 182/33.2 |
| 1,051,656 | A | | 1/1913 | Whitaker | |
| 1,052,750 | A | | 2/1913 | Phillips | |
| 1,216,172 | A | | 2/1917 | Schulz | |
| 1,270,029 | A | * | 6/1918 | Heule et al. | 297/153 |
| 1,447,145 | A | | 7/1923 | Morrell | |
| 1,505,829 | A | | 8/1924 | Warnecke | |
| 2,407,646 | A | * | 9/1946 | Best | 297/153 |
| 2,446,601 | A | | 4/1948 | Lelyveld | |
| 2,526,767 | A | * | 10/1950 | Parker | 297/188.1 |
| 2,607,946 | A | | 8/1952 | Price | |
| 2,628,870 | A | | 2/1953 | Schultz | |
| 2,658,640 | A | * | 11/1953 | Bayles | 297/188.1 |
| 2,765,025 | A | | 10/1956 | Bakalic et al. | |
| 2,888,977 | A | | 6/1959 | Thaden | |
| 4,059,305 | A | * | 11/1977 | Ammirata | 297/338 |
| 4,165,124 | A | | 8/1979 | Olan | |
| 4,883,317 | A | * | 11/1989 | Davenport | 297/188.1 |
| 5,230,524 | A | * | 7/1993 | Jackson | 280/47.38 |
| 5,458,395 | A | * | 10/1995 | Skarda, Jr. | 297/188.1 |
| 5,718,475 | A | * | 2/1998 | Watts | 297/127 |
| 5,927,805 | A | * | 7/1999 | Hilger et al. | 297/239 |
| 6,145,931 | A | | 11/2000 | Subotic | |
| 6,378,720 | B1 | * | 4/2002 | Santa Cruz et al. | 220/495.06 |
| 2003/0107247 | A1 | * | 6/2003 | Wills et al. | 297/217.1 |
| 2005/0134091 | A1 | * | 6/2005 | Rashidy et al. | 296/203.01 |

* cited by examiner

*Primary Examiner*—Peter M. Cuomo
*Assistant Examiner*—Sarah B. McPartlin
(74) *Attorney, Agent, or Firm*—Arthur J. Carlson

(57) ABSTRACT

A chair with back and arms, adapted for putting on and removing footwear, wherein the seat is located approximately twenty-two inches above the local grade and wherein the arms extend approximately twenty-two inches from the back; consisting also of a stationary, outwardly extending, and attached footrest approximately eight inches below the seat. The chair may further have a storage compartment formed beneath the seat.

4 Claims, 1 Drawing Sheet

Chair with Attached Footrest for Putting on and Removing Footwear

Chair with Attached Footrest for Putting on and Removing Footwear

CHAIR WITH ATTACHED FOOTREST FOR PUTTING ON AND REMOVING FOOTWEAR

BACKGROUND OF THE INVENTION

1. Field of the Invention

This invention relates to chairs. More specifically, it relates to a chair adapted to facilitate putting on and removing one's shoes.

2. Description of Related Art

For the purpose of putting on and removing their shoes, people usually sit on a chair, bed, or other seating area in their bedroom (such as a bench, stool, trunk, or window seat). Some people sit on the floor. Those who have homes with a stairwell in proximity to the room where they get dressed often sit on a stair and place their feet on the next step down, which is an easy-to-reach distance for putting on and removing their shoes.

There is currently no item of furniture with a stationary, attached footrest designed specifically for ease and comfort in putting on and taking off one's shoes. The prior art includes two examples of articles intended for this purpose, but these articles employ retractable footrests, which are difficult to use by the elderly and others who have difficulty reaching their feet because of the bending over that is required. These inventions require the user to bend over and reach down, while already seated, in order to manually extend the footrest.

The combined stool and retractable, single-foot footrest disclosed in U.S. Pat. No. 6,145,931 issued to Subotic requires the user to sit down on a relatively low seat and then bend over to pull out the retractable footrest. Subotic included no arms to help users steady themselves in sitting down or to help the users stand up. Moreover, the retractable footrest has a slanted shoe support, which places one's foot at a difficult-to-reach angle.

The dressing chair disclosed in U.S. Pat. No. 1,505,829 issued to Warnecke also has a retractable, single-foot footrest. Warnecke requires the user to bend over to pull out the footrest, which positions one's foot at a difficult-to-reach angle.

The night stand disclosed in U.S. Pat. No. 2,628,870 issued to Schultz is not designed, as a whole, for putting on and removing one's shoes, but it does include a retractable footrest and slanted foot support, which can be used for this purpose. The seat portion is low, and without arms, and is difficult to use by the elderly and others who have difficulty putting on and removing shoes.

The footrest for chairs disclosed in U.S. Pat. No. 155,016 issued to Eberhard has a retractable footrest, which is close to the floor. Its purpose is for resting one's feet while sitting. The footrest is too close to the floor to make one's feet easy to reach for the purpose of putting on and removing one's shoes.

The adjustable chair disclosed in U.S. Pat. No. 799,171 issued to Bartlett also has a retractable footrest, which is close to the floor. Bartlett includes a slanted footrest for resting one's feet while sitting.

The footrests for chairs disclosed in U.S. Pat. No. 155,524 issued to Lambert has a retractable footrest, which extends out from directly below the seat. Its purpose is for stretching out and resting one's legs while sitting. Lambert could be used for putting on and removing shoes, but this would be difficult because the angle of the footrest extends away from the user and because the footrest is much too close to the seat.

The combined stool and retractable footrest disclosed in U.S. Pat. No. 2,607,946 issued to Price has a footrest, which can be pulled out if the user wants a place to rest his feet while sitting on the stool. The footrest is too far below the stool top to easily reach one's shoes. Moreover, the user is required to first sit down and then bend over to retract the footrest.

The combined chair and apparel cabinet disclosed in U.S. Pat. No. 4,165,124 issued to Olan has a footrest, which can be pulled out from beneath the seat if the user wishes to extend his or her legs and have a place to rest his or her feet. Because the footrest is only a few inches below the seat, it would be awkward and uncomfortable to use it for putting on or removing one's shoes.

The stool and shoe receptacle disclosed in U.S. Pat. No. 1,447,145 issued to Morrell consists of a stool and storage area for shoes underneath, but has no footrest for putting on or removing one's shoes.

The children's hamper with steps combined disclosed in U.S. Pat. No. 2,658,640 issued to Bayles could be used for the purpose of putting on and removing one's shoes. However, it is not a chair with back and arms, and the hamper platform, which could be used a seat, is low and thus difficult for the elderly or disabled to sit on and then get up again (especially with no arms to assist this process). To modify this hamper to approximate the present invention would not be obvious to a person having ordinary skill in the art (i.e., the art pertaining to children's hampers); that is, it would not be obvious to modify a children's hamper to make it into a chair.

The chair for children disclosed in U.S. Pat. No. 794,461 issued to Mackey consists of two parts. The upper part is a rocking chair for children, and the lower part is a base, which can also be used as a seat. When joined together, these parts make a high chair for children. The lower portion has a slidable drawer underneath the seat. It would be awkward to use this drawer as a footrest: the user would have to bend over and reach down to extend the drawer, and the drawer is open on the top and does not provide a flat surface to be used as a footrest (in other words, it is a drawer, not a footrest).

The footrest disclosed in U.S. Pat. No. 1,051,656 issued to Whitaker consists of a low stool on wheels with a stationary footboard close to the floor and also featuring an angled footrest to be used on someone trying on new shoes in a shoe store. The footrest portion is angled so as to be used by a customer sitting opposite the stool; it is not used by the salesperson sitting on the stool. The angled footrest can be collapsed so as to rest horizontally in the footboard. Although Whitaker did not anticipate this use, the footboard could be used by the person sitting on the stool to put on or remove his or her own shoes. Such usage would be awkward as the footboard is close to the floor, making one's feet difficult to reach. Moreover, the device is a stool, not a chair; the seat is relatively low, and has no arms or back. It would be extremely difficult and unsafe to be used by the elderly or disabled or putting on or removing shoes.

The combined trash receptacle and step stool disclosed in U.S. Pat. No. 6,378,720 issued to Santa Cruz and Gittelman has a platform, which could be used as a seat, and the retractable step stool could be used as a footrest. It is not a chair with a stationary footrest: it has no arms or back, and the step stool would have be manually pulled out from underneath the "seat" to be used as a footrest.

The utility chair disclosed in U.S. Pat. No. 2,765,025 issued to Bakalic et. al. contains drawers for storage underneath the seat, but does not contain a footrest. Nor could the drawers be used as a footrest because they extend out from the sides of the seat, not in front of the seat.

The footstool disclosed in U.S. Pat. No. 1,052,750 issued to Phillips is designed as a footstool to be used in shoe stores. The user (i.e., a customer in a shoe store) sits opposite the footstool, which can then be used (by the customer or salesperson) to put on or remove the customer's shoes. A person could sit on the stool and use the angled footrest portion to put on or remove his or her own shoes. However, this would be awkward and would require a difficult bending-over movement to reach one's shoes, as the footrest is angled in the wrong direction (i.e., away from the stool).

The multi-purpose chair disclosed in U.S. Pat. No. 4,883,317 issued to Davenport consists of a seat with a retractable drawer underneath. To use the drawer as a footrest, it would have be pulled out manually and the user would have to place his or her feet on the top edge of the drawer front or sides. This would be awkward and uncomfortable. The drawer is a drawer; it is not designed as a footrest with a flat surface on which to put one's feet. Moreover, the chair has no arms to assist in sitting down and getting up.

Many people have difficulty in putting on and removing their shoes because of the bending over that is required. This is especially true of the elderly, people who are significantly over-weight, people with back pain or stiffness, and people with other physical limitations or disabilities. Even those without physical problems would welcome the comfort and ease that this invention provides in the daily activity of putting on and removing their shoes.

SUMMARY OF THE INVENTION

The present invention addresses the problems associated with the prior art by incorporating elements into a single chair/footrest apparatus specifically designed to create ease-of-use and comfort in putting on and removing one's shoes. An embodiment of the present invention comprises a substantially rectangular seat having an underside, a front seat edge, a back seat edge, and first and second opposing side seat edges. The width of the seat may be about 20 inches and its depth may be about 14 inches. The seat further comprises first and second back seat corners formed at intersections of the back seat edge with the first and second side seat edges. The embodiment further may comprise first and second back posts about 42 inches in length, the back posts being disposed to extend downward from the seat a distance of about 22 inches. First and second side panels having bases of about 20 inches and back edges of about 18 inches may be disposed to support the seat. In an exemplary embodiment, substantially rectangular portions are removed from front upper corners of the side panels. The removed portion may have a size about 8 inches in height and may range from about 7 and about 9 inches in depth. The back edges may be secured to and supported by the back posts. The embodiment still further may comprise a substantially rectangular footrest stationarily disposed on and supported by a portion of the side panels not removed, the not-removed side panel portion being adapted to support the footrest at a position about 8 inches below the seat. An embodiment of the footrest, which may have a width substantially the same as the width of the seat and a depth not less than about 7 inches and not more than about 9 inches, may comprise two front corners and an underside. First and second front legs may be secured to the underside of the footrest at the front corners thereof and may extend below the footrest. This arrangement of the seat and the footrest may enable an individual sitting on the seat to be able to conveniently put on and remove footwear when feet of the individual are placed on the footrest. First and second front posts, which may be secured to front edges of the side panels and which may extend upward from the bases of the side panels to upper extents about 12 inches above the footrest, may support first and second arms having back edges and front ends. The back edges of the arms may be secured to the back posts at a height about 4 inches above the seat. The arms may extend forward horizontally from the back posts to a position above the upper extents of the front posts to which the front ends of the arms may be secured and by which the front ends of the arms may be supported. For convenience, a storage compartment may be disposed below the seat.

DETAILED DESCRIPTION

Figure 1:
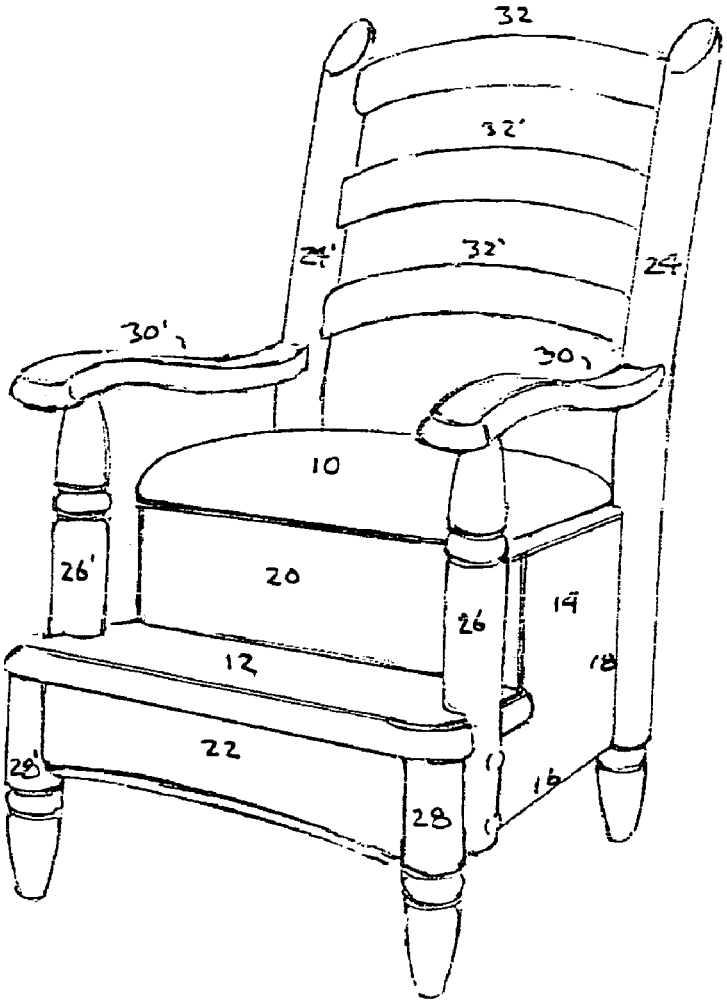
FIG. 1 is a pictorial view of an embodiment of the present invention.

FIG. 1 shows an exemplary embodiment of a combined chair and attached footrest constructed according to the present invention. The illustrated embodiment has a seat 10, a footrest 12 and two side panels 14 and 14'. (A first side panel 14 is illustrated in FIG. 1; a second side panel 14' is not shown in FIG. 1.) The seat 10 is typically a rectangle having a size of about 14 inches by 20 inches, and the footrest 12 is typically a rectangle of size about 9 inches by 20 inches. Each rectangle identified herein, e.g., the seat 10 and footrest 12, may be understood to have edges and corners. For example, referring to FIG. 1, the seat 10 and footrest 12 of the combined chair and attached footrest may be understood to have two front corners, two back corners, a front edge, a back edge, and first and second opposing side edges. The front, back, and first and second opposing side edges of the seat 10 may be referred to, respectively, as a front seat edge (which may, in some contexts presented herein, be referred to as the front of the chair), a back seat edge (which, likewise, may be referred to as the back of the chair in some contexts appearing herein), and first and second opposing side seat edges.

The footrest 12 of the embodiment illustrated in FIG. 1 is typically disposed about 8 inches below the seat 10. Both the seat 10 and footrest 12 are supported at a first side edge by the first side panel 14, which has a base 16 of approximately 20 inches and a back edge 18 of approximately 18 inches. The undersides of the seat 10 and footrest 12 are similarly supported at a second, opposing, side edge by the second side panel 14' (not shown). First side panel 14 may be formed substantially as a rectangle having a horizontal base 16 of approximately 20 inches and a height of about 18 inches from which a substantially rectangular portion has been removed from a corner thereof. Dimensions of the removed portion may include a height of about 8 inches consistent with the disposition of the footrest 12 about 8 inches below the seat 10 as disclosed supra. Dimensions of the removed portion further may include a depth ranging from about 7 inches to about 9 inches commensurate with dimensions of the footrest 12 as likewise disclosed supra. When the removed rectangular portion is considered, the side panel 14 may be understood to have an upper edge about 14 inches in length capable of supporting an edge of the seat 10.

The illustrated embodiment further comprises a substantially vertically-oriented upper face 20 disposed below the front of the seat 10 and extending to the back edge of the footrest 12. The upper face 20 typically has a shape of a rectangle about 8 inches high by about 20 inches wide. A substantially vertically-oriented lower face 22 may extend below the front edge of the footrest 12 to approximately 4 inches above a support surface such as a floor and is typically a rectangle about 4 inches by 20 inches in size, a lower edge of which may be slightly rounded as illustrated in FIG. 1. Respective back posts 24 and 24' extend from the floor to approximately 20 inches above the seat 10, thereby comprising a length of about 42 inches in the illustrated embodiment. That is, as disclosed infra, the seat 10 may be positioned approximately 22 inches above the floor. It should be understood that first and second back posts 24 and 24' extend downward from the seat 10 to the floor, a distance of about 22 inches, and upward from the seat 10 for an additional length of about 20 inches. Accordingly, the length of the first and second back posts 24 and 24' may be about 22 plus 20 or about 42 inches.

A first front post 26 having a top end may extend from the base 16 and front edge of the first side panel 14 to approximately 12 inches above the footrest 12. A second front post 26' may, likewise, have a top end and may extend from a base and front edge of the second side panel 14' (not shown) to approximately 12 inches above the footrest 12. Respective first and second front legs 28 and 28' extend from the floor to the base of the footrest 12 in the illustrated embodiment. First and second back posts 24 and 24' and first and second front legs 28 and 28' must be of sufficient strength to support the chair and to provide sufficient stability to preclude the chair from tipping.

The illustrated embodiment further comprises first and second side arms 30 and 30'. First side arm 30 extends approximately 22 inches from first back post 24 and is attached thereto at a level approximately 4 inches above the seat 10. The first side arm 30 also attaches to the top end of the first front post 26. Similarly, second side arm 30' attaches to second back post 24' and extends approximately 22 inches from the second back post 24' and attaches to the top end of the second front post 26'. Three ladder-back supports 32, 32', and 32', each approximately 2½ inches wide, are attached to sides of the first and second back posts 24 and 24' as shown. (It is understood that the ladder-back supports 32, 32', and 32' may be of other forms, such as multiple spindles of a Windsor chair, an upholstered cushion, or another conventional chair back form.) The seat 10, which sits on top of and is supported by upper edges of the side panels 14 and 14', is typically about 22 inches from the floor. Below the seat 10 is a storage compartment (not shown), interior dimensions of which are typically 18 inches wide, 12 inches deep, and 16 inches in height. The dimensions cited above define an embodiment of the present invention, which is suitable for an average-size adult.

In designing the present invention, different versions were tested in order to determine the optimal height of the seat and positioning of the arms and footrest. Eleven individuals participated in this testing, including two children (ages 7 and 10) and five seniors over 65 years old. The testing proceeded as follows. First, the height of the seat was varied between 18 inches and 24 inches, and it was determined that a height of 22 inches was optimal for most users. Second, different distances between the seat and footrest were employed in order to determine the most comfortable distance. The distances ranged between five inches to eleven inches. Some taller subjects preferred to have the footrest located at approximately ten inches below the seat, and some shorter subjects preferred to have the footrest located at approximately six inches below the seat. The average preferred distance was eight inches. Third, different dimensions of the footrest were tested. It was determined that the footrest should be at least 7 inches in depth in order to accommodate one's foot, but that it should not be more than 9 inches in depth (as explained above).

Once these dimensions were determined, a prototype was made and used by the 11 subjects to put on their shoes. Each person found that the prototype facilitated this activity. The height of the seat and the position of the arms made it easy and comfortable for the testers to lower themselves onto to the seat. They then lifted their feet onto the footrest, which was now attached at the average preferred distance of eight inches below the seat. Each subject found, regardless of height or age, that this distance made it easy to reach their feet to put on and remove their shoes. The elderly testers expressed their appreciation of the fact that no bending over was required to reach their feet. All the subjects found that it was easy to stand up from the seated position because of the height of the seat and the design of the arms. The elderly noted that getting up from the prototype was much easier than getting up from a normal chair.

The testing of the prototype of this invention with several elderly adults led to a conclusion that five elements were critical in creating ease-of-use in lowering oneself down onto the chair (with the assistance of the first and second side arms 30 and 30'), lifting one's feet onto the footrest 12, using the footrest 12 to put on or remove one's shoes (one's feet being in an easy-to-reach position), and then using the first and second side arms 30 and 30' to stand up from the seated position. In the prior art, there is no chair with an attached, stationary footrest that combines these five critical elements.

The five elements of a representative embodiment of the present invention may be summarized as follows:

1) The seat portion of the chair (e.g., the seat 10 in FIG. 1) is higher than a normal chair in order to be easy to sit upon and get up again. This is a critical aspect as the chair is intended for the elderly and others who have difficulty in lowering themselves onto a chair of normal height and getting up from such chairs. While the seat of a normal chair is located approximately 18 inches from a support surface such as a floor, the seat of the present invention is placed approximately 22 inches from the floor.

The arms (e.g., first and second side arms 30 and 30' of FIG. 1) of the present invention extend out from the back of the chair so that the fronts of the first and second side arms 30 and 30' are over the front corners of the footrest 12. This is a critical aspect because the user stands facing away from the seat, and uses the first and second side arms 30 and 30' to lower himself or herself onto the seat. In order for the user to easily hold onto the front of the first and second side arms 30 and 30', the arms must extend out to the position described herein.

The footrest (e.g., footrest 12 in FIG. 1) is approximately 8 inches below the seat 10. This is a critical aspect because it positions the user's feet, once lifted onto the footrest 12, at an easy-to-reach distance from the seat 10. If the footrest 12 is positioned closer to the seat 10, it makes it difficult for many users to lift their feet onto the footrest 12 and requires an uncomfortable bending of one's legs at the knees. If the footrest 12 is positioned closer to the floor, it requires a difficult bending-over motion to reach one's feet when placed on the footrest 12.

4) The footrest 12, which is stationary, is attached to the upper face 20 disposed at the front of the chair (cf. FIG. 1). This is a critical aspect for two reasons. Because it is attached (as opposed to being a separate component), the user does not need to first sit down and then, using his or her feet, move the footrest 12 into position. A separate, non-attached footrest could also tip over or slide out of position. Because the footrest 12 is stationary, the user is not required to bend over and pull out the footrest 12.

5) The footrest 12 extends no more than 9 inches from the front of the chair. This is a critical aspect because the user stands facing away from the seat 10 and then lowers himself or herself onto the seat 10, and the distance that the footrest 12 extends from the chair determines how far the user will be standing from the seat 10. If the footrest 12 extends more than 9 inches, then it forces the user to stand too far from the seat 10, and it makes sitting down difficult.

It has been determined that the present invention offers a new and useful apparatus of special utility to those who have difficulty in the daily tasks of putting on or removing their shoes because of the bending over that is required. The stationary footrest 12 of the present invention is attached to the upper face 20 situated at the front of the chair as shown in FIG. 1. While the footrest 12 provides ease and comfort for any user, it is specifically designed for those individuals who normally have difficulty in putting on and removing their shoes, and it may thereby circumvent shortcomings in the prior art.

To provide extra convenience, an embodiment of the present invention may contain a storage compartment under the seat for one's shoes, socks, and/or foot apparel such as sandals or slippers. Thus, these items can be conveniently ready-at-hand within the storage compartment when a person uses the chair to put on his or her shoes. When the person uses the chair to remove his or her shoes, these can be conveniently put away in the storage compartment.

Children can also use an embodiment of the present invention. Frequently, when small children put on shoes while sitting on a chair, they bring their feet onto the seating surface. With the present invention, they can use the footrest 12 to comfortably reach their feet.

It is understood that the dimensions disclosed above may be varied within a fairly wide range to suit a particular user or for stylistic purposes. For example, when the present invention is to be made for children, the position of the seat 10 would be lower, and the other dimensions would be adjusted accordingly. Conversely, if the present invention is to be made for adults of above-average size, the width of the seat 10 would be wider, and the other dimensions would be adjusted accordingly.

It is understood that the present invention can be fabricated from any of numerous suitable materials. In the simplest construction, it may be constructed from sheets of plywood or other suitable sheet goods material such as oriented strand board, or medium density fiberboard or wood. Other suitable materials for the construction would include metals, polymers, and composites such as glass-filled polymers. The material selected for construction must have sufficient strength, rigidity and stiffness to support a user in the chair, and yet be sufficiently light in weight that the chair can be moved to a chosen location without undue stress to the user and without requiring use of additional moving equipment.

Although the present invention has been described above, and shown in FIG. 1, with reference to an illustrated embodiment, workers skilled in the art will recognize that changes may be made in form and detail without departing from the spirit and scope of the invention.

What is claimed is:

1. A chair, comprising:

a substantially rectangular seat having an underside, a front seat edge, a back seat edge, and first and second opposing side seat edges, the seat having a width of about 20 inches and a depth of about 14 inches, the seat further having first and second back seat corners formed at intersections of the back seat edge with the first and second side seat edges;

first and second back posts having lengths of about 42 inches, the back posts being secured to the seat at the first and second back seat corners, the back posts extending downward about 22 inches from the seat;

first and second side panels having bases of about 20 inches and back edges of about 18 inches, each side panel having a substantially rectangular portion removed from a front upper corner thereof, the substantially rectangular portion being about 8 inches in height and between about 7 and 9 inches in dept, thereby leaving an upper edge on each side panel, each upper edge being about 14 inches in length, the upper edges supporting the seat, the back edges being secured to and supported by the back posts;

a substantially rectangular footrest stationarily disposed on and supported by the side panels at a position about 8 inches below the seat, the footrest having:

a width substantially the same as the width of the seat;

a depth not less than 7 inches and not more than 9 inches;

two front corners; and an underside; and first and second front legs secured to the underside of the footrest at the front corners and extending below the footrest, whereby an individual sitting on the seat is able conveniently to put on and remove footwear when feet of the individual are placed on the footrest;

a storage compartment disposed below the seat;

first and second front posts, the front posts being secured to front edges of the side panels and extending upward from the bases of the side panels to upper extents about 12 inches above the footrest; and first and second arms, the arms having back edges and front ends, the back edges being secured to the back posts at a height about 4 inches above the seat, the arms extending forward horizontally from the back posts to a position above the upper extents of the front posts, the front ends of the arms being secured to and supported by the upper extents of the front posts.

2. The chair as set forth in claim 1, wherein the chair is constructed of at least one type of material selected from the group consisting of oriented strand board, medium density fiberboard, wood, metals, polymers, and composites.

3. The chair as set forth in claim 2, wherein the at least one type of material comprises a composite material.

4. The chair as set forth in claim 3, wherein the composite material comprises glass-filled polymers.

* * * * *